US008413949B2

(12) United States Patent
Schwoerer

(10) Patent No.: US 8,413,949 B2
(45) Date of Patent: Apr. 9, 2013

(54) CLIMBING SHOE IN THE BUILDING SECTOR

(75) Inventor: Artur Schwoerer, Senden (DE)

(73) Assignee: Peri GmbH, Weissenhorn (DE)

( * ) Notice: Subject to any disclaimer, the term of this patent is extended or adjusted under 35 U.S.C. 154(b) by 0 days.

(21) Appl. No.: 11/917,927

(22) PCT Filed: Jun. 20, 2006

(86) PCT No.: PCT/DE2006/001046

§ 371 (c)(1),
(2), (4) Date: Dec. 18, 2007

(87) PCT Pub. No.: WO2007/000137

PCT Pub. Date: Jan. 4, 2007

(65) Prior Publication Data

US 2010/0212237 A1 Aug. 26, 2010

(30) Foreign Application Priority Data

Jun. 29, 2005 (DE) ..... 10 2005 030 332

(51) Int. Cl.
*E04G 11/20* (2006.01)

(52) U.S. Cl.
USPC ..... 249/18; 182/82; 425/65; 249/20; 249/219.1

(58) Field of Classification Search ..... 182/2.1, 182/2.2, 2.3, 82; 249/18–22, 219.1; 425/63, 425/65; 264/33
See application file for complete search history.

(56) References Cited

U.S. PATENT DOCUMENTS

| | | | | | |
|---|---|---|---|---|---|
| 1,995,692 | A * | 3/1935 | Urschel | 425/63 |
| 2,027,499 | A * | 1/1936 | Tully | 280/492 |
| 2,616,648 | A * | 11/1952 | Budreck | 248/487 |
| 3,606,237 | A * | 9/1971 | Stephens | 249/20 |
| 3,991,969 | A * | 11/1976 | Oxyer | 249/20 |
| 4,060,358 | A * | 11/1977 | Fougea | 425/65 |
| 4,148,852 | A * | 4/1979 | Dashew | 264/33 |
| 4,290,576 | A | 9/1981 | Schwoerer | |
| 4,374,634 | A * | 2/1983 | Ahl | 425/65 |
| 4,397,441 | A * | 8/1983 | Manderla | 249/19 |
| 4,709,899 | A * | 12/1987 | Kajioka et al. | 249/20 |
| 4,809,814 | A * | 3/1989 | St-Germain | 182/132 |
| 5,080,533 | A * | 1/1992 | Cooper | 405/282 |
| 5,368,125 | A * | 11/1994 | St-Germain | 182/146 |
| 6,502,362 | B1 * | 1/2003 | Zambelli et al. | 52/698 |
| 6,557,817 | B2 * | 5/2003 | Waldschmitt et al. | 249/20 |
| 7,581,709 | B2 * | 9/2009 | Gillespie et al. | 249/19 |
| 2002/0139917 | A1 * | 10/2002 | Arozena Bergaretxe | 249/189 |
| 2005/0217934 | A1 * | 10/2005 | Choo | 182/82 |

FOREIGN PATENT DOCUMENTS

| | | | |
|---|---|---|---|
| DE | 28 14 930 | | 7/1986 |
| DE | 196 41 813 | | 4/1998 |
| EP | 34819 | A2 * | 9/1981 |
| FR | 2 298 662 | | 8/1976 |
| FR | 2 487 410 | | 1/1982 |
| GB | 1 360 103 | | 7/1974 |
| GB | 2 090 900 | | 7/1982 |
| WO | WO 2004/020766 | | 3/2004 |

* cited by examiner

*Primary Examiner* — Katherine Mitchell
*Assistant Examiner* — Daniel Cahn
(74) *Attorney, Agent, or Firm* — Paul Vincent

(57) ABSTRACT

A climbing shoe (10) comprises a sliding shoe section (16) and wall shoe section (18). The sliding shoe section (16) is designed so that it can guide and hold a climbing rail. The wall shoe section (18) is connected to the sliding shoe section (16) in an articulated manner.

2 Claims, 10 Drawing Sheets

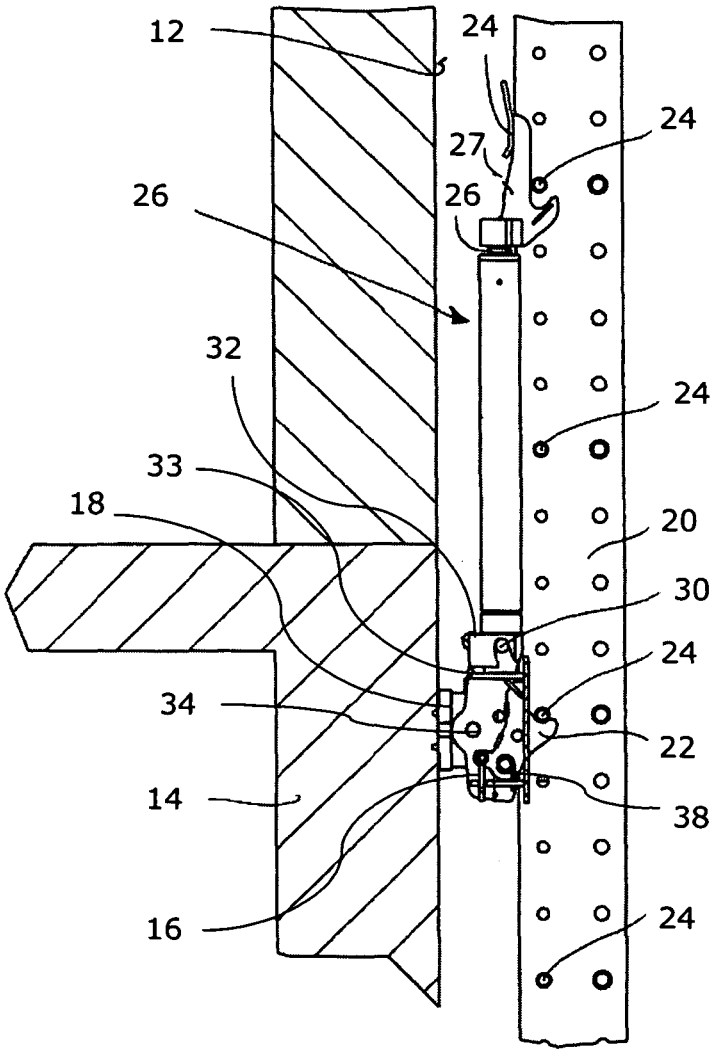
Fig. 1.1

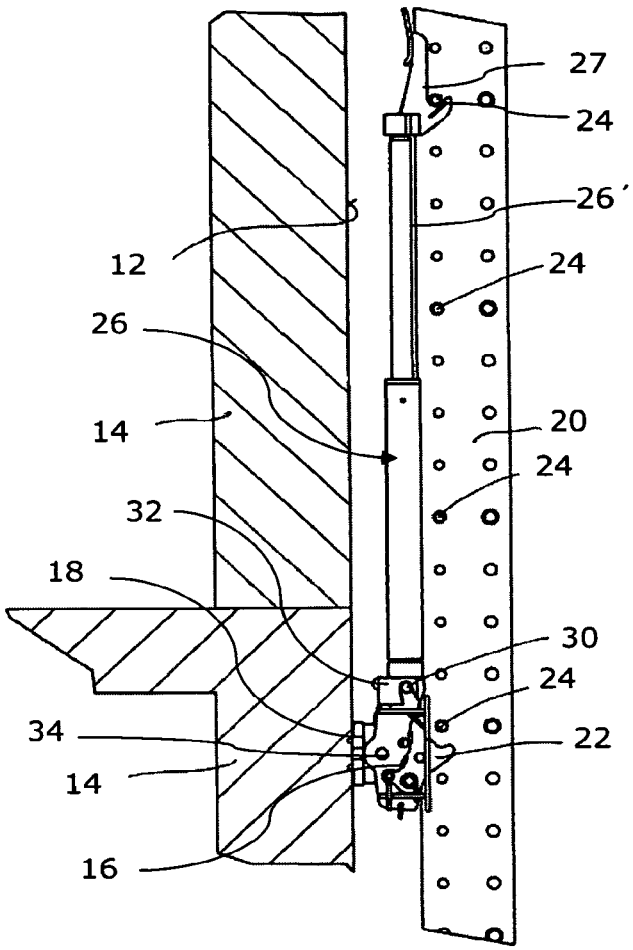
Fig. 3.1

CLIMBING SHOE IN THE BUILDING SECTOR

The invention relates to a climbing shoe in the building sector as used to hold rails on walls of a structure on already produced concrete sections. The known climbing shoes guide and hold the climbing rail on the wall, whereby the necessary fittings for erecting a new concrete section can be applied to the climbing rails. Within the climbing shoes the climbing rails can be moved as required and firmly held in the required positions in the climbing shoes. As large loads act on the climbing shoes and the anchoring points provided in the wall via the climbing shoes attached there, both the anchoring points and the climbing shoes must be structurally designed so that they can take up these forces securely and durably.

DE 196 41 813 A1 discloses a working frame which can be attached to a wall or a roof. The working frame has load-carrying spar running parallel to the wall, in the upper section of which a suspension hook is provided. The suspension hook is attached to the load-carrying spar by means of socket pins and suspended in a load-bearing bolt of an anchoring plate.

FR 2 298 662 A shows and describes a climbing casing which has form boards which are in contact with both sides of a wall to be concreted. Each form board can be lifted by way of a device and their angle adjusted with regard to the outer surface of the wall to be concreted. By a prop and fastening devices parallel to the wall, the device is attached to an already hardened concrete section. The fastening devices each have a load-carrying spar arranged perpendicularly to the wall and pivotably mounted to a wall section anchored in the wall.

The aim of the invention is to provide a climbing shoe which introduces as moment-free forces as possible, resulting from the weight of the climbing rail and the connected fittings, into an anchoring point in a wall and/or can take these up in a moment-free manner.

The aim is achieved through a climbing shoe in the building sector which has a sliding shoe section and a wall or ceiling shoe section, whereby the wall or ceiling shoe section can be firmly attached to a wall or ceiling of a concrete section and the sliding shoe has means for guiding and holding a climbing rail, whereby the wall or ceiling shoe section is connected to the sliding shoe section in an articulated manner, and whereby the wall or ceiling shoe section is pivotable about a vertically arranged axis and the sliding shoe section is pivotable with respect to the wall or ceiling shoe section about a horizontally arranged axis.

By the articulated connection forming a cardan joint between the wall or ceiling and sliding shoe section it is possible for the sliding shoe section to attach to the climbing rail, with a climbing rail taking up the load, and thereby acting as a counter bearing to the catches formed in the sliding shoe section which as supports hold the load-bearing bolts of the climbing rail. The articulated bearing allows the sliding shoe section to be aligned with regard to the climbing rail, the wall or ceiling shoe section and to the anchoring point in the wall in accordance with force flow optimised points of view. If climbing shoes have cardan joints, climbing rails held in the climbing shoes can always be aligned in parallel to each other. This also allows the parallel alignment of fittings on the climbing rails, e.g. consoles or rails.

In a further embodiment of the invention the wall or ceiling shoe section is connected to the sliding shoe section by a detachable stub shaft. This has the advantage that the climbing shoe can be divided if required. This allows easier mounting or removal of a climbing rail. The articulated catches borne in the sliding shoe section serve as supports for load-bearing bolts of the climbing rails and the catches can be pivoted within the sliding shoe section in such a way that moving of the climbing rails within a sliding shoe section is possible. When the climbing rails climb the catches are disengaged from the load-bearing bolts and once a climbing procedure has ended the catches automatically pivot back into their initial position and can again hold the climbing rail immobile on the wall of a structure in its new position.

The climbing shoe in accordance with the invention is shown and described in the following figures. The joints shown and described in the embodiment are to be understood as examples and can also be formed by other structural embodiments. The load-carrying bolts of the climbing rail can also be replaced with openings, brackets or projections that can engage in the appropriate catch recesses of the sliding shoe section.

Of course also climbing shoes can be used that exclusively have one joint in the wall or ceiling shoe section and have a rigid connection between the wall or ceiling shoe section and the sliding shoe section. This joint can be vertically or horizontally arranged.

The figures show the embodiments of the invention in a strongly schematic form and are not to scale.

The same functional elements are largely denoted with the same reference numbers in the figures described below. These functional elements can be designed in the most different ways.

Figure 1:
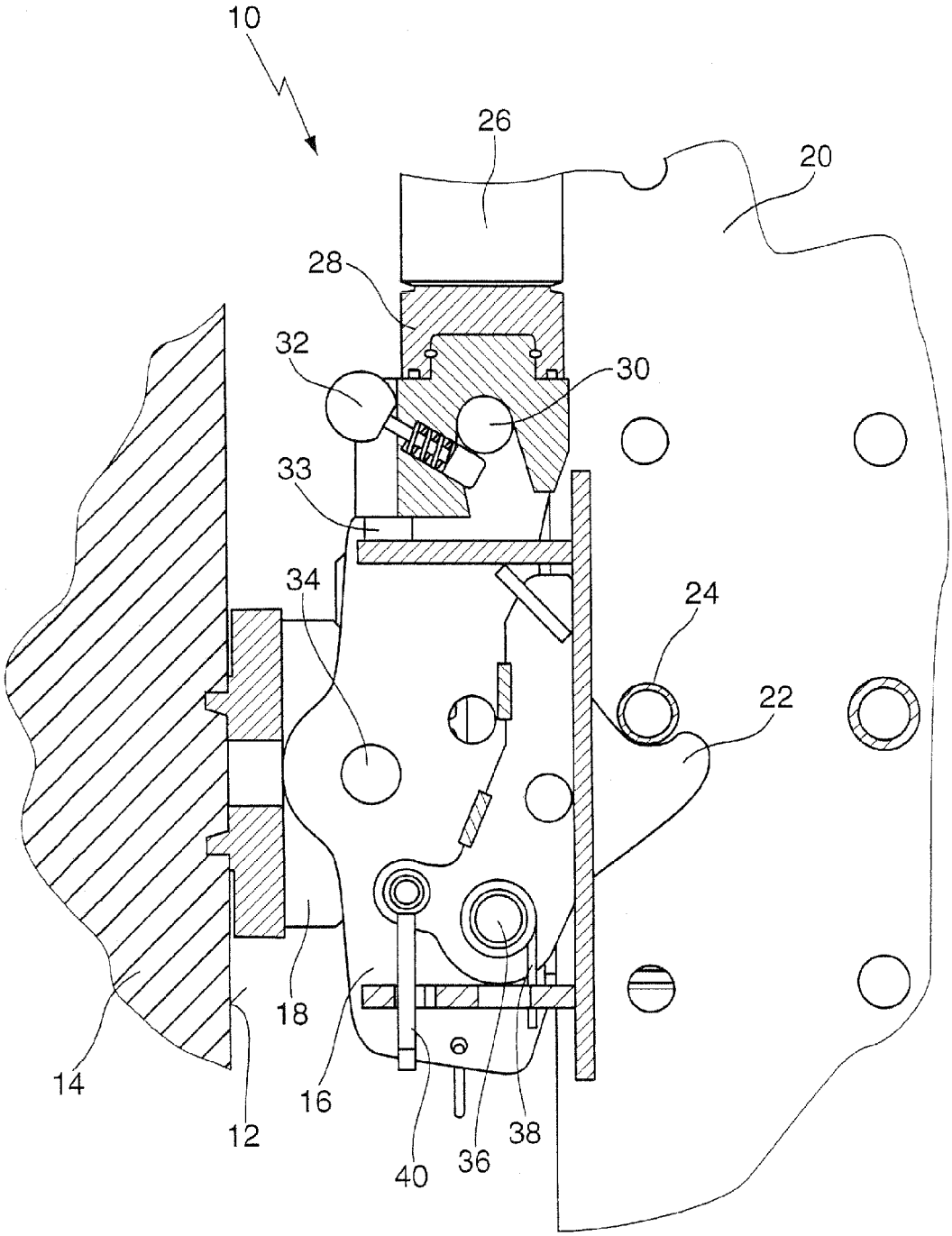
FIG. 1 shows in a cross-section through a climbing shoe in accordance with the invention how it is attached in a stationary manner to a concrete wall and immovably guides and holds a climbing rail.

FIG. 1 shows in a side view and partial cross-section of a climbing shoe 10 how it is attached in a stationary manner to a wall 12 of a concrete section 14 at an anchoring point. The climbing shoe 10 comprises a sliding shoe section 16 and a wall shoe section 18. A climbing rail 20 is held via a catch 22 of the sliding shoe section 16 and laterally guided in that the catch 22 supports from below a load-carrying bolt 24 of the climbing rail 20. The catch 22 is shown in its maximum pivoted out position and counter bearings within the sliding shoe 16 prevent further clockwise pivoting of the catch 22.

A climbing cylinder 26 is mounted on the sliding shoe section 16 of the climbing shoe 10. Only the lowest part of the climbing cylinder 26 can be seen to which a casing 28 is connected via which the climbing cylinder 26 is disposed onto an articulated shaft 30 of the climbing shoe 10. A securing bolt 32 fixes the casing 28 to the articulated joint 30 without impairing the pivoting range of the climbing cylinder 26 about the articulated shaft 30. If the securing bolt 32 is disengaged from the articulated shaft by pulling against the spring force, the climbing cylinder 26 can be removed from the articulated shaft 30. The casing 28 of the climbing cylinder 26 is supported via a rubber or viscoplastic element 33 on a casing wall of the sliding shoe section 16.

The sliding shoe section 16 is connected in an articulated manner to the wall shoe section 18 by way of a horizontally arranged stub shaft 34. The sliding shoe section 16 can be pivoted with respect to the wall shoe section 18 about the stub shaft 34.

Within the sliding shoe section 16 the catch 22 can be pivoted in an anticlockwise direction about a pivoting point 36 against the pressure of a spring 36.

If the catch 22 is not subjected to a weight load via load-carrying bolts 24 of the climbing rail 20, the catch 22 can be manually pivoted in the sliding shoe section 16 against the pressure of the spring 38 using the lever 40. This is always necessary when the climbing rail 20 has to be moved downwards with respect to the stationary climbing shoe 10. The figure only shows details of the concrete section 14, the climbing rail 20, and the climbing cylinder 26.

Figure 2:
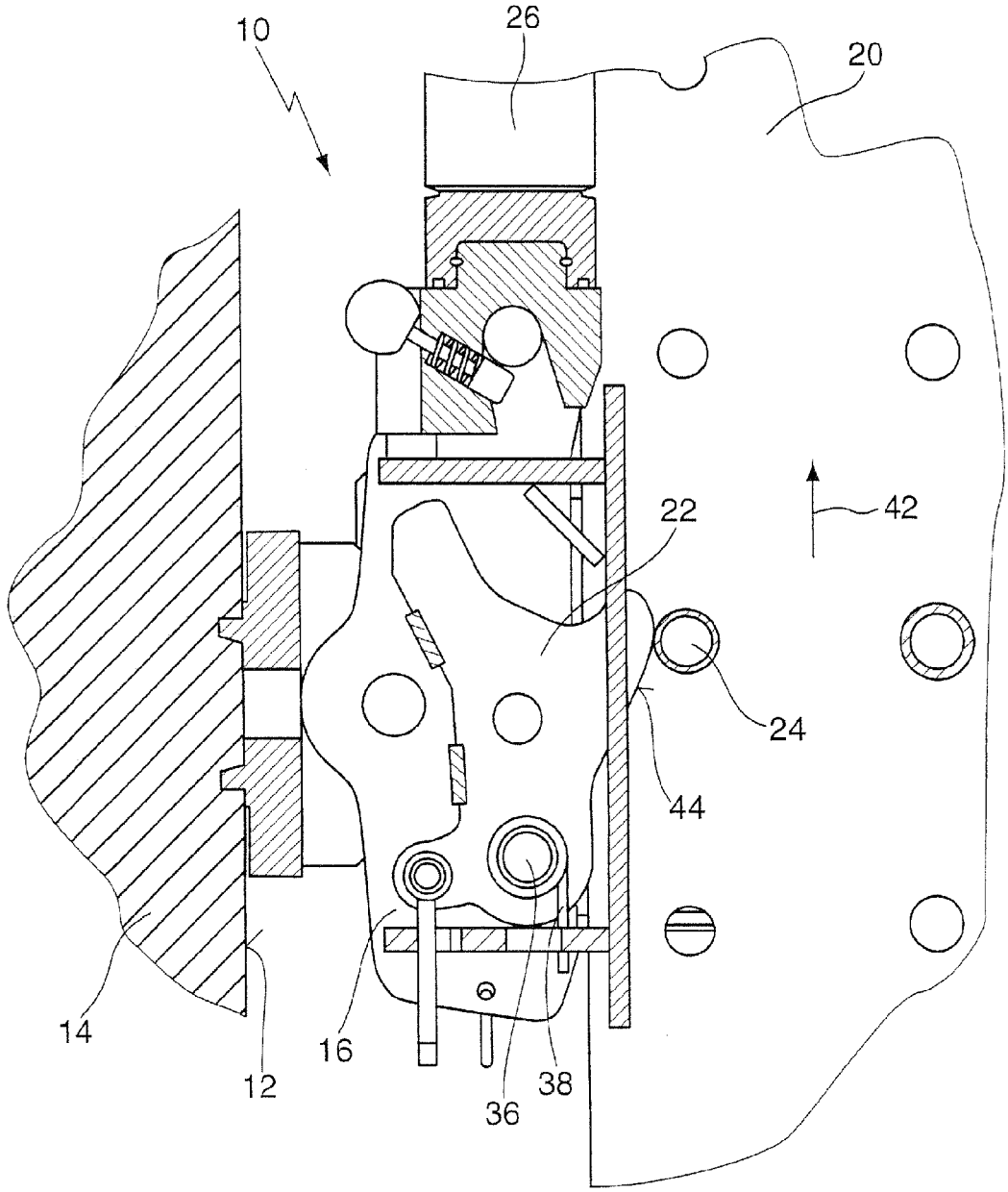
FIG. 2 shows a cross-section through a climbing shoe in accordance with the invention with a catch pivoted into the climbing shoe.

FIG. 2 shows a moment uptake of the climbing rail 20 as it is moved upwards in the direction of the arrow 42 via the climbing cylinder 26 along a wall 12 of the concrete section 14. For this climbing procedure of the climbing rail 20 in the direction of the arrow 42 the piston of climbing cylinder 26 is extended, which grips and supports the load-carrying bolt 24 of the climbing rail 20 from underneath.

If the climbing rail 20 is moved via the climbing cylinder 26 in the direction of the arrow 42, a load-carrying bolt 24 of the climbing rail 20 is pressed onto an overrun slope 44 of the catch 22 and pivots the catch 22 about the point of rotation 36 against the pressure of the spring 38. The catch 22 then pivots into the sliding shoe section 16 of the climbing shoe 10.

Figure 3:
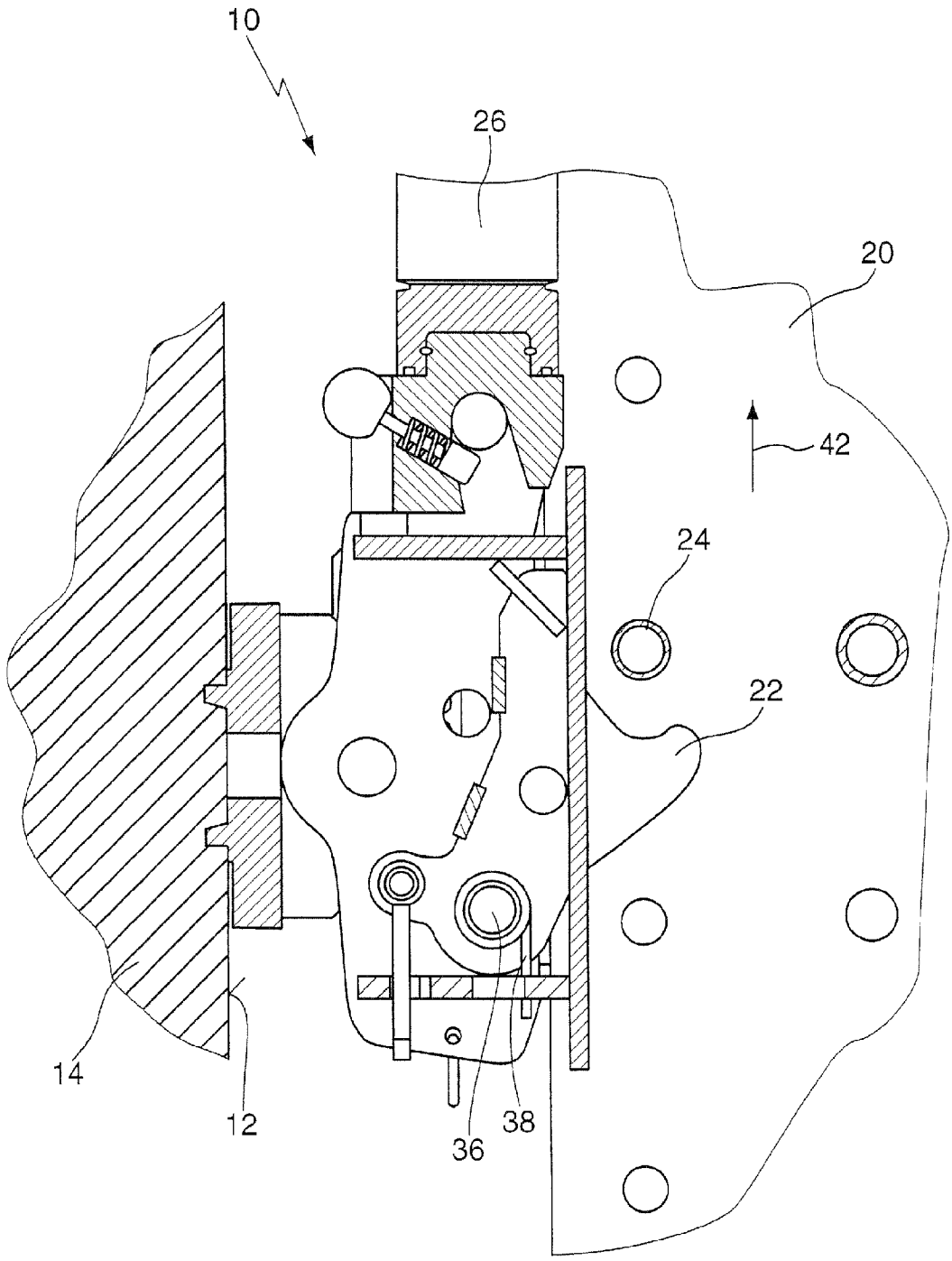
FIG. 3 shows a cross-section through a climbing shoe in accordance with the invention in accordance with FIGS. 1 and 2 with the catch pivoted out of the climbing shoe and not engaged with a load-carrying bolt.

FIG. 3 shows the climbing shoe 10 in FIGS. 1 and 2 on the wall 12 of the concrete section 14, how the catch 22 pivots back about the point of rotation 36 into its initial position through the force of the spring 38. The climbing rail 20 was moved further by the climbing cylinder 26 in the direction of the arrow 42 so that the load-carrying bolt 24 has released the catch 22 again which has been able to pivot back into its initial setting.

If the climbing cylinder 26 is retracted, the load-carrying bolt 24 comes to rest on the catch 22 of the climbing shoe 10 and the climbing shoe 10 holds the climbing rail 20 in the position on the wall 12 of the concrete section 14 shown in the figure.

Figure 4:
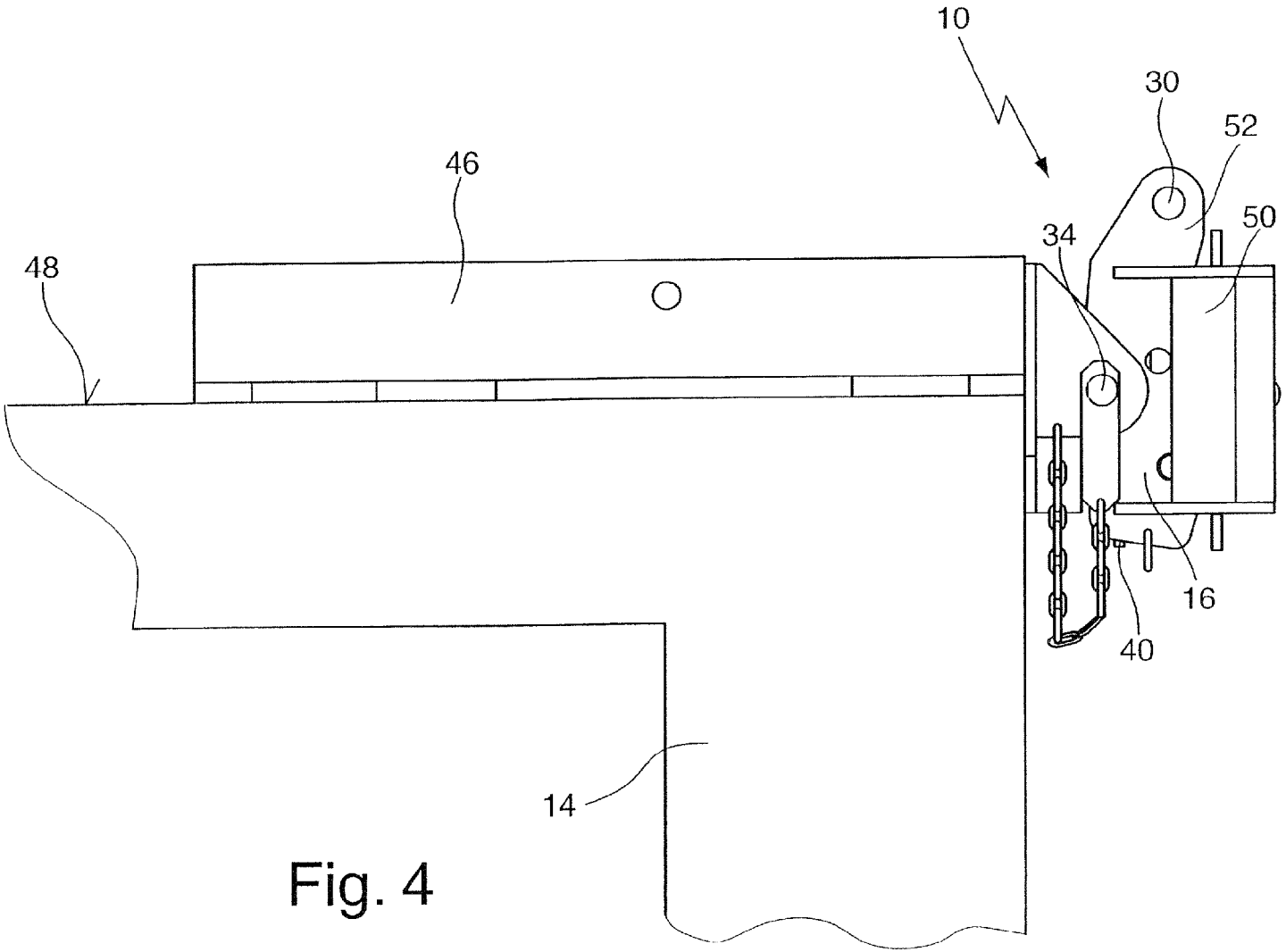
FIG. 4 shows a climbing shoe with a ceiling shoe section disposed on and fastened to the ceiling of a concrete section.

FIG. 4 shows a side view of a modified climbing shoe 10 composed of the sliding shoe section 16 and a ceiling shoe section 46. The ceiling shoe section 46 rests on a ceiling 48 of the concrete section 14 and is also fastened there in a stationary manner. Via the sub shaft 34 the sliding shoe section 16 is attached in an articulated manner to the ceiling shoe section 46. If the stub shaft 34 is removed from the ceiling shoe section 46 the sliding shoe section can be removed from the ceiling shoe section 46 with claws 50. The catch or the catches of the sliding shoe section 16, which grips below the load-carrying bolts of the climbing rail when the climbing rail is inserted or can be pivoted by the load-carrying bolts during a climbing procedure, are covered by the claws 50. The lever 40, which is attached in an articulated manner to the catch in the sliding shoe section 16 is shown in the figure and via the lever 40 the catch/catches in the sliding shoe section 16 can be pivoted by hand.

A bracket 52 is shown on the sliding shoe section 16 which bears the articulated shaft 30. A climbing cylinder can be mounted on the articulated shaft 30.

Figure 5:
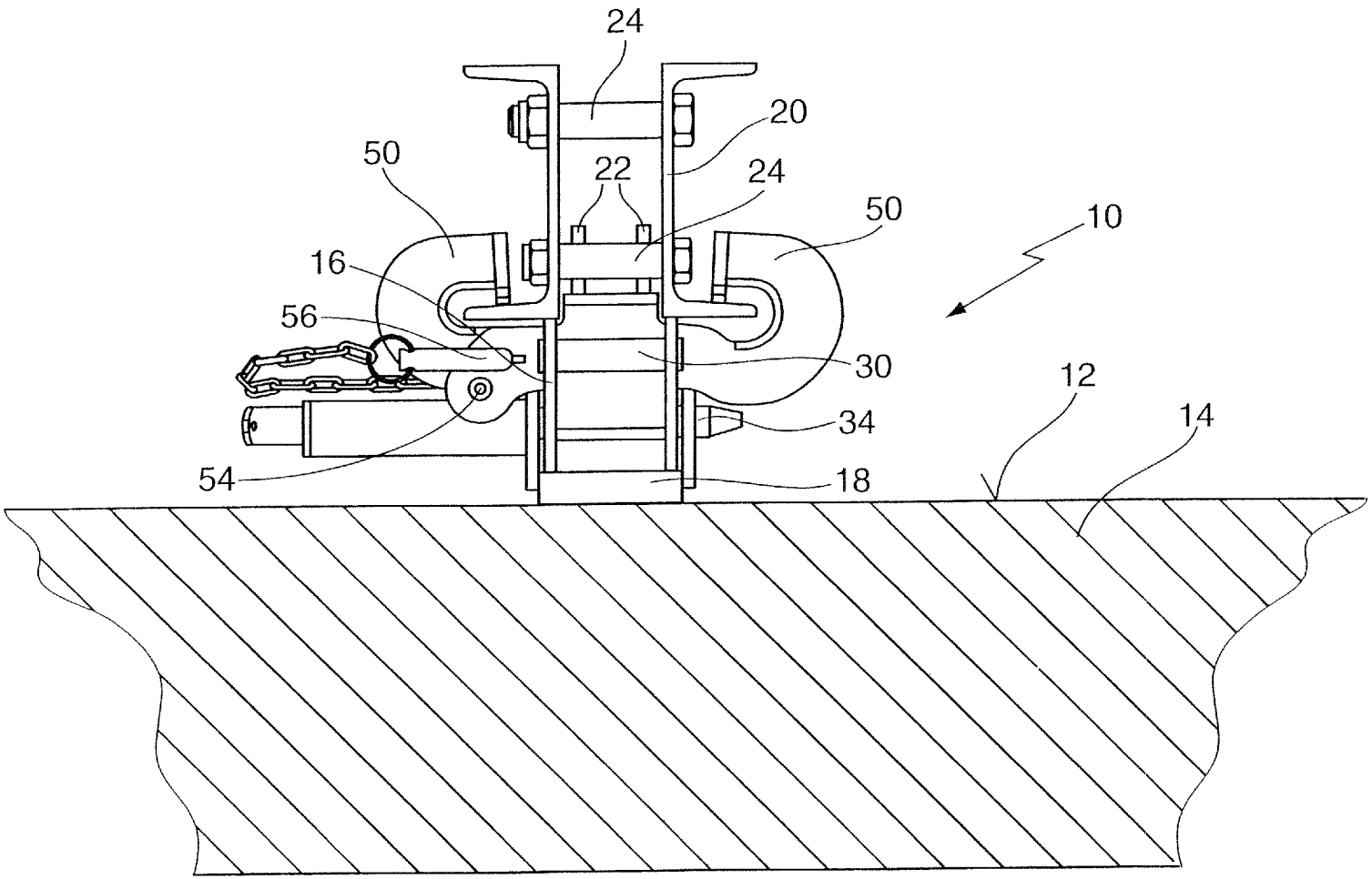
FIG. 5 shows a top view of a climbing shoe attached to a concrete section grasping a climbing rail with claws.

FIG. 5 shows a top view of how a climbing shoe 10 comprising a sliding shoe section 16 and wall shoe section 18 is attached in a stationary manner to the wall 12 of the concrete section 14. The sliding shoe section 16 is connected in an articulated manner to the wall shoe section 18 via the stub shaft 34. The claws 50 encompass the limbs of the U-shaped profile of the climbing rail 20 and hold the climbing rail 20 guided on the wall 12. Catches 22 of the sliding shoe section 16 support the load-bearing bolt 24 on one side of the climbing rail 20. Arranged on the sliding shoe section 16 is the articulated shaft 30 for mounting a climbing cylinder. One half of the claws 50 can be pivoted about an axis 54 if a locking bolt 56 preventing possible pivoting of the left claw 50 is pulled out of its holding device.

Figure 6:
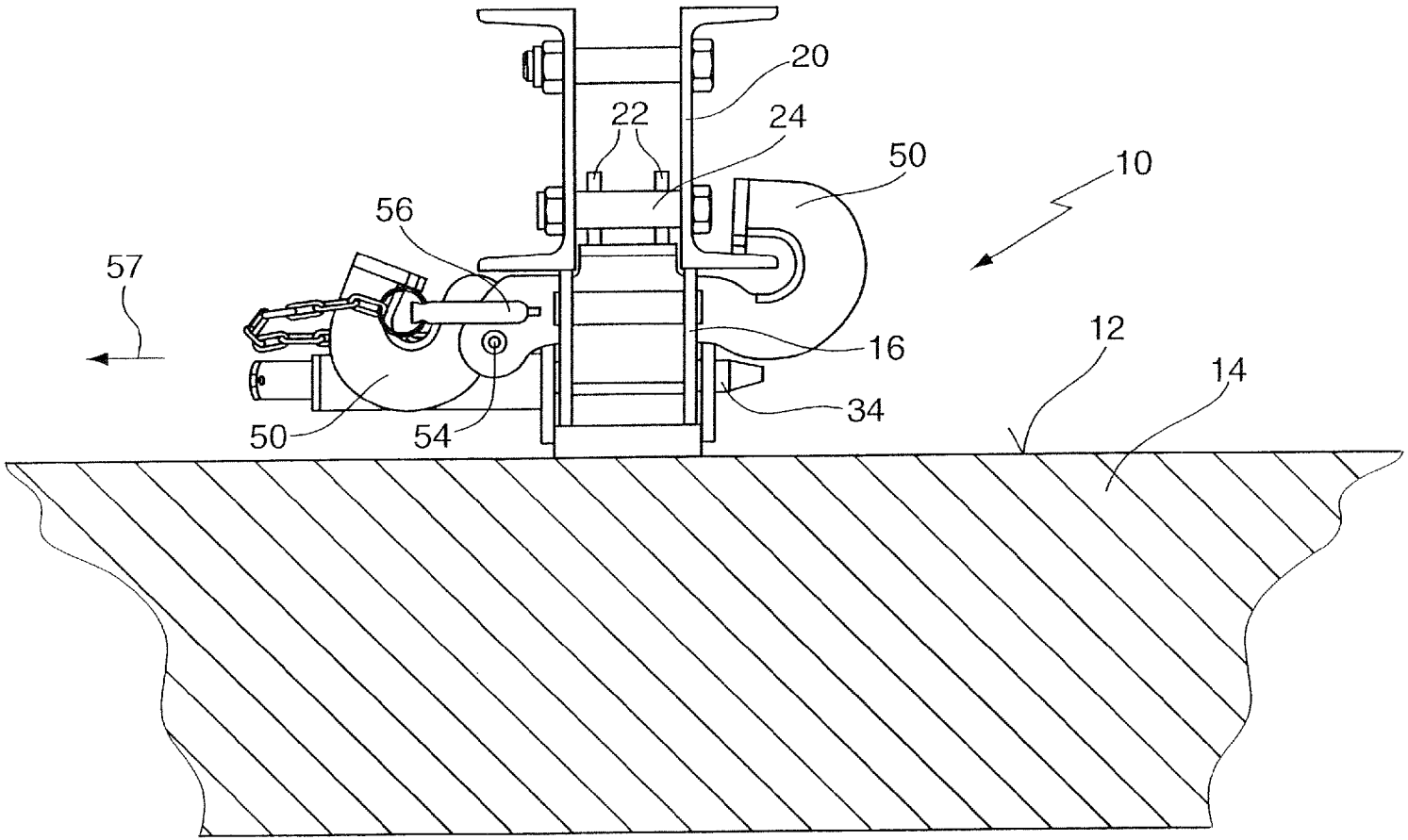
FIG. 6 shows a top view of a climbing shoe attached to a concrete section of a wall with a claw opened on one side for removal from a climbing rail.

FIG. 6 shows the climbing shoe 10 in FIG. 5 with a claw 50 swung out on one side.

If a climbing shoe 10 on a wall 12 of the concrete section 14 is to be dismounted or removed even in the presence of the climbing rail 20, one claw 50 of the sliding shoe section 16 can be swung open if the locking bolt 56 is disengaged from a rigid wall section of the sliding shoe section 16 and is pulled out of an aperture in the claw 50. Once the locking has been released the claw 50 can be pivoted about the axis 54. If the claw 50 is swung open the locking bolt 56 can be replaced in its position that locks the claw 50 and it is then guaranteed that the claw 50 remains in the position shown in the figure. If the stub shaft 34 between the sliding shoe section 16 and the wall shoe section 18 is removed, by pulling it out of the joint bearing in direction of the arrow 57 the sliding shoe section 16 can be removed from the climbing rail 20. If required the wall shoe section 18 can then also be loosened and removed from the anchoring point in the wall.

Figure 7:
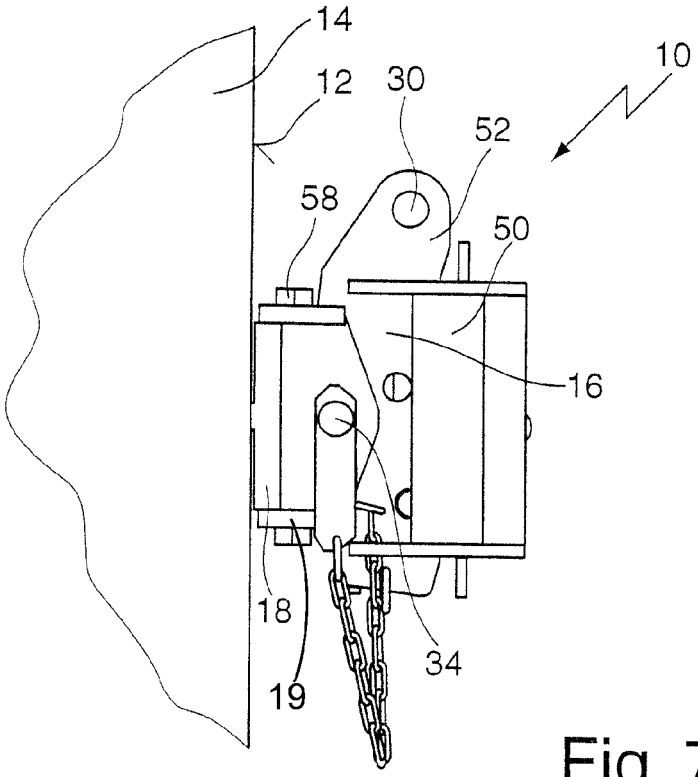
FIG. 7 shows a side view of a climbing shoe attached in a stationary manner to the wall of a concrete section with a cardan joint about a horizontally and vertically aligned axis.

FIG. 7 shows a side view of a cardan-borne climbing shoe 10 on the wall 12 of the concrete section 14. The sliding shoe section 16 is horizontally connected in an articulated manner to the connecting shoe section 19 via the stub shaft 34. In addition to the climbing shoes in FIGS. 1 to 6 the wall bracket 18 has a vertical axis 58 about which the connecting shoe section 19 with the sliding shoe section 16 can be pivoted if required. On the sliding shoe section 16 is the bracket 52 which bears the articulated shaft 30. The claws 50 cover the catches 22 arranged between the claws 50.

Figure 8:
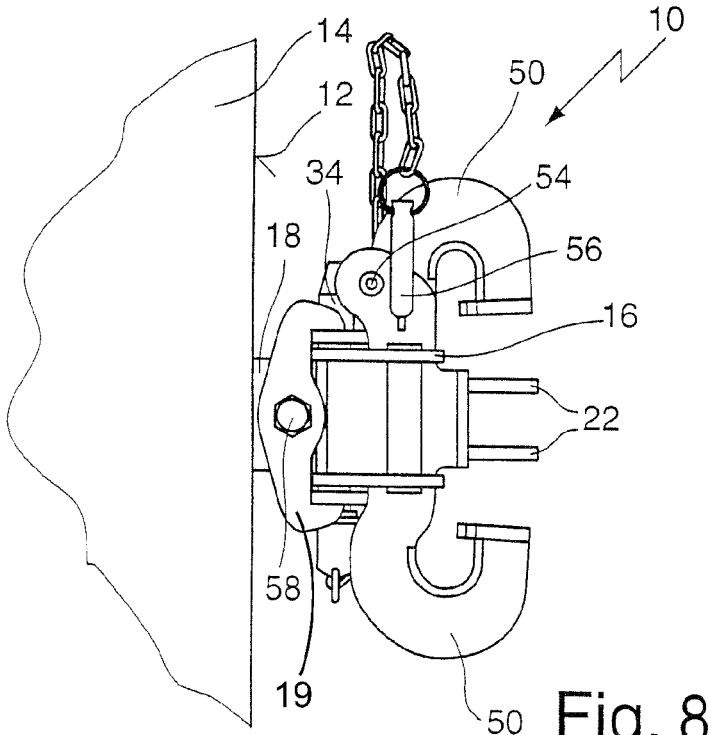
FIG. 8 shows a top view of a climbing shoe in accordance with FIG. 7.

FIG. 8 shows a top view of the cardan-borne climbing shoe 10 of FIG. 7. The climbing shoe 10 is held stationary on the wall 12 of the concrete section 14 and can pivot about the vertical axis 58 and about the horizontal axis formed by the stub shaft 34. The sliding shoe section 16 is pivotably held on the connecting shoe section 19 via the stub shaft 34 and via the axis 58 the connecting shoe section 19 can pivot independently of the sliding shoe section. A claw 50 is borne in a pivoting manner about axis 54, whereby the locking 56 in the locking position brings about a rigid claw connection between the sliding shoe section 16 and the pivotable claw 50. The pivotable catches 22 are arranged between the claws 50 in the sliding shoe section 16.

Figure 9:
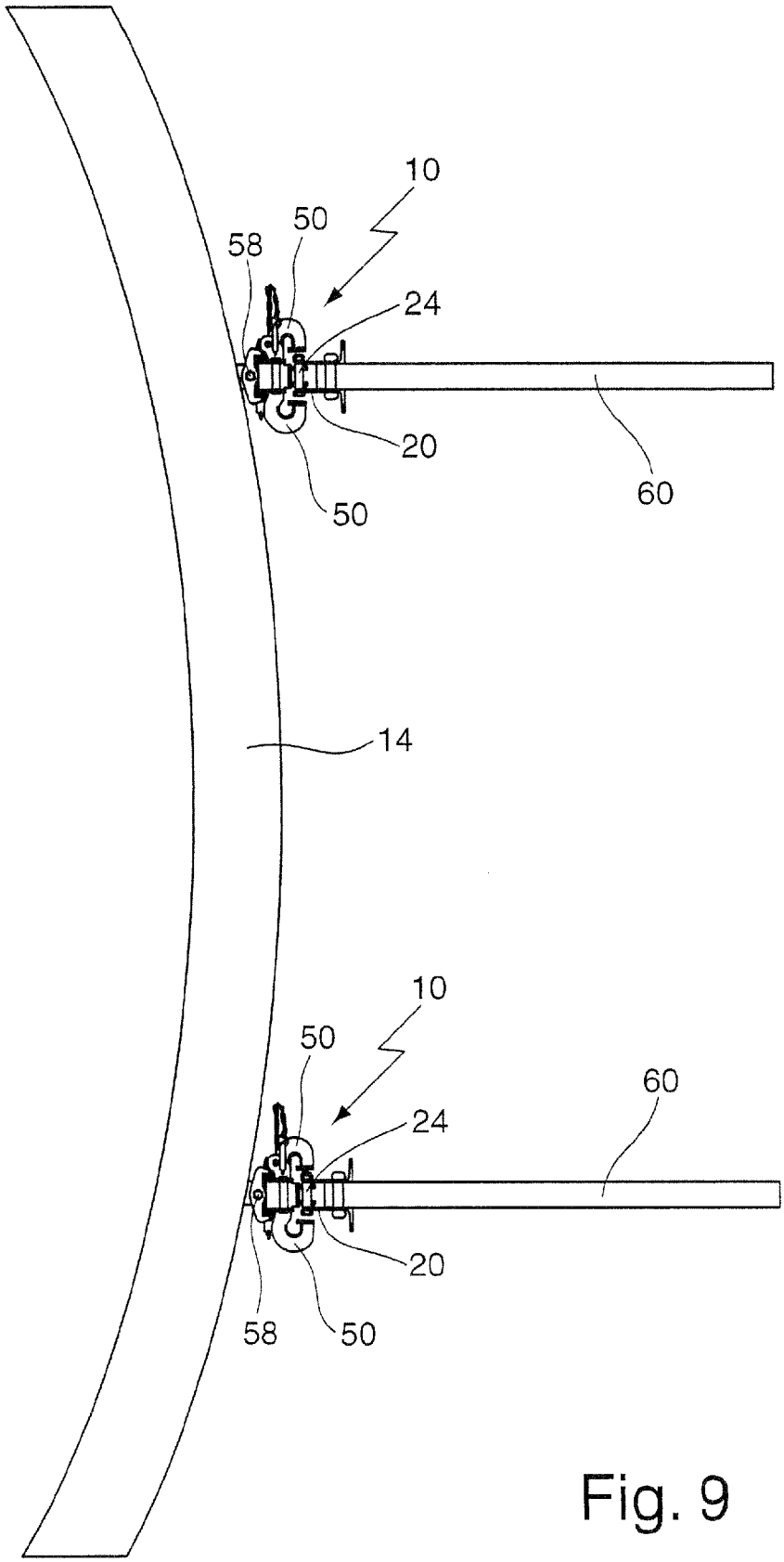
FIG. 9 shows a climbing shoe attached with a cardan joint and in stationary manner to a convex wall of a concrete section with climbing rails holding consoles or rail elements that are arranged in parallel.

FIG. 9 shows a top view of a concrete section 14 which is shown rounded. Attached at anchoring points provided on the concrete section 14 are the climbing shoes 10 which each guide a climbing rail 20 between the claws and via the catches arranged in the climbing shoes 10 the climbing rails 20 are held in position by the load-carrying bolts 24 provided in the climbing rails 20.

Attached to the climbing rails 20 are consoles and/or rails 60 which via the cardan-borne climbing shoes 10 are always arranged in parallel on the concrete section 14. If the consoles or rails 60 are always in parallel even in the presence of differing curves in the concrete section 14, formwork carriages can be moved to and from the concrete section 14 via the rails 60. Via the vertical axes 58 the climbing shoes 10 with the climbing rails are always aligned so that the consoles 60 or rails are always parallel to each other, independently of the curvature radius of the concrete section 14.

A climbing shoe 10 comprises a sliding shoe section 16 and a wall shoe section 18. The sliding shoe section 16 is designed so that it can guide and hold a climbing rail. The wall shoe section 18 is connected in an articulated manner to the sliding shoe section 16.

I claim:

1. A climbing shoe in combination with a climbing rail for use with a climbing formwork having the climbing rail for construction of a concrete building having a wall and a ceiling, the climbing shoe comprising:

a bracket, said bracket structured for mounting to a vertical surface of the wall or ceiling;

a connecting shoe section;

a first pivot mechanism disposed between and cooperating with said bracket and said connecting shoe section, wherein said connecting shoe section pivots relative to said bracket about a vertical axis defined by said first pivot mechanism;

a sliding shoe section, said sliding shoe section structured for guiding the climbing rail within said sliding shoe section; and a second pivot mechanism disposed between and cooperating with said connecting shoe section and said sliding shoe section, wherein said sliding shoe section pivots relative to said connecting shoe section about a horizontal axis defined by said second pivot mechanism, said first and said second pivot mechanisms thereby defining a cardan joint between said bracket and said sliding shoe section.

2. The climbing shoe of claim 1, wherein said second pivot mechanism comprises a detachable stub shaft.

* * * * *